US009393533B2

(12) United States Patent
Little et al.

(10) Patent No.: US 9,393,533 B2
(45) Date of Patent: Jul. 19, 2016

(54) BLENDER

(75) Inventors: Dennis James Little, Nelson (NZ); Christopher John Little, Nelson (NZ)

(73) Assignee: LITTLE JEM (NEW ZEALAND) LIMITED, Hope, Richmond (NZ)

( * ) Notice: Subject to any disclaimer, the term of this patent is extended or adjusted under 35 U.S.C. 154(b) by 495 days.

(21) Appl. No.: 13/994,964

(22) PCT Filed: Dec. 8, 2011

(86) PCT No.: PCT/NZ2011/000254

§ 371 (c)(1),
(2), (4) Date: Jun. 17, 2013

(87) PCT Pub. No.: WO2012/087154

PCT Pub. Date: Jun. 28, 2012

(65) Prior Publication Data

US 2013/0265847 A1 Oct. 10, 2013

(30) Foreign Application Priority Data

Dec. 24, 2010 (NZ) ..... 590241

(51) Int. Cl.

| | |
|---|---|
| ***B01F 7/16*** | (2006.01) |
| ***B01F 7/00*** | (2006.01) |
| ***B01F 7/24*** | (2006.01) |
| ***B01F 15/00*** | (2006.01) |

(52) U.S. Cl.

CPC ..... *B01F 7/00416* (2013.01); *B01F 7/1605* (2013.01); *B01F 7/245* (2013.01); *B01F 15/00967* (2013.01); *B01F 2215/0021* (2013.01)

(58) Field of Classification Search

CPC ..... B01F 7/00416
USPC ..... 62/342; 366/286, 289
See application file for complete search history.

(56) References Cited

U.S. PATENT DOCUMENTS

| | | | | | |
|---|---|---|---|---|---|
| 2,626,133 | A | * | 1/1953 | Reed | A23G 9/045 366/206 |
| 3,061,279 | A | * | 10/1962 | Reed | A23G 9/045 187/256 |
| 3,323,320 | A | * | 6/1967 | Conz | A23G 9/16 366/251 |
| 4,548,054 | A | * | 10/1985 | Levine | A23G 9/28 366/203 |
| 4,548,508 | A | | 10/1985 | Verkler | |
| 4,708,489 | A | * | 11/1987 | Carlson | A23G 9/282 241/199.12 |
| 4,740,088 | A | * | 4/1988 | Kelly, Jr. | A23G 9/04 366/138 |
| 5,067,819 | A | | 11/1991 | Heinhold et al. | |

FOREIGN PATENT DOCUMENTS

WO 91/06221 A1 5/1991

OTHER PUBLICATIONS

International Search Report; mailed Apr. 16, 2012; PCT/NZZ2011/000254.

* cited by examiner

*Primary Examiner* — David Sorkin
(74) *Attorney, Agent, or Firm* — Ladas & Parry LLP

(57) ABSTRACT

A blender including (i) a base with an interior space; (ii) a hollow central column extending upwardly from the base; (iii) a top housing mounted to the top of the column, a motor, drive transmission means and a drive shaft; (iv) an auger attached to a distal end of the drive shaft (v) a mixing bowl in coaxial alignment with the auger, (vi) a mixing bowl holder for releasably holding the mixing bowl in coaxial alignment; (vii) a ball screw drive mechanism housed within the column and for moving the mixing bowl in linear movement toward and away from the auger; and (viii) a splash guard positioned above the auger.

27 Claims, 7 Drawing Sheets

BLENDER

FIELD OF INVENTION

The invention relates to a blender for mixing ingredients, typically ice cream, frozen yoghurt or other base product with condiments (fruits, nuts, etc), flavours or liquids (e.g. milk), to form a homogenous and well mixed product, typically a soft smooth dessert or drink such as a milk shake or smoothie.

BACKGROUND OF INVENTION

Blenders for mixing frozen product, such as ice cream, to a substantially soft, smooth product are known. These known blenders are disclosed in U.S. Pat. Nos. 7,503,687, 5,439,289, 5,067,819, 4,828,398, 4,974,965 and 3,352,543 respectively, in which a variety of additives such as fruits, nuts, biscuits, confectionary, flavourings, essences, etc can be rapidly mixed with a frozen product.

Whilst the above mentioned published patents had advantages over the prior art they have disadvantages, such as the use of a hand lever and/or belt/pulley/gear arrangement for the raising and lowering of the mixing bowl relative to the auger.

OBJECT OF THE INVENTION

It is an object of the invention to provide a blender for mixing ingredients (typically ice cream, frozen yoghurt or other base product with condiments (fruits, nuts, etc), flavours or liquids (e.g. milk)) to form a homogenous and well mixed product (typically a soft smooth dessert or drink such as a milk shake or smoothie) that ameliorates some of the disadvantages and limitations of the known art or at least provide the public with a useful choice.

SUMMARY OF INVENTION

In a first aspect the invention resides in a blender for mixing ingredients, typically ice cream, frozen yoghurt or other base product with condiments (fruits, nuts, etc), flavours or liquids (e.g. milk), to form a homogenous and well mixed product, typically a soft smooth dessert or drink such as a milk shake or smoothie, the blender includes:

(i) a base having an interior space therein;
(ii) a hollow central column extending upwardly from the base;
(iii) a top housing mounted to the top of the column, the top housing having a motor, drive transmission means and a drive shaft, the drive shaft extends downwardly and outwardly from said top housing;
(iv) an auger attached to a distal end of the drive shaft
(v) a mixing bowl having an open top, the mixing bowl is in substantially coaxial alignment with the auger,
(vi) a mixing bowl holder for releasably holding the mixing bowl in said substantially coaxial alignment;
(vii) a ball screw drive mechanism housed within the column and connectable to the mixing bowl holder for moving the mixing bowl in linear movement toward and away from the auger; and
(viii) a splash guard positioned above the auger wherein the splash guard is adapted to fit within and cover the opening of the mixing bowl when the blender is in use.

Preferably, the column defines an interior space in which the ball screw mechanism is situated.

Preferably, the ball screw mechanism includes:

(i) a vertically orientated ball screw situated within the interior space of the column extending upwardly from the base to the top housing;
(ii) a screw nut threadingly connected to the ball screw; and
(iii) a screw block attached to the screw nut such that the screw block is adapted to move up and down upon rotation of the ball screw.

Preferably, the ball screw is drivingly connected to a reversible motor housed in the interior of the base such that ball screw can be rotated in one direction to move the screw block up the length of the ball screw and can be rotated in the opposite direction to move the screw block down the length of the ball screw.

Preferably, the reversible motor is a variable speed DC motor so that the speed of rotation of the screw ball can be varied and controlled.

Preferably, the reversible motor is coupled to a gear reduction box situated between the reversible motor and the ball screw.

Preferably, the base includes a PLC therein to control the operation of the reversible motor and the drive motor.

Preferably, that base includes therein all the electronic components required for the operation and control of the blender.

Preferably, the base includes start and stop switches for starting and stopping the operation of the blender.

Preferably, the base has adjustable feet depending downwardly therefrom.

Preferably, the base includes a horizontal upper base plate.

Preferably, the base includes a drip tray situated directly below and in alignment with mixing bowl.

Preferably, a vertically aligned slot in the column, where the slot extends a portion of the length of the column.

Preferably, the screw block has a portion that extends through the slot whereby the distal end of said portion is connected to a collar positioned on and surrounding the circumference of the column.

Preferably, the collar is adapted to slide up and down the column as the screw block is caused to move up and down the ball screw.

Preferably, the collar is attached to the mixing bowl holder whereby the mixing bowl holder extends outwardly from the collar and situated to be positioned in coaxial alignment with auger such that the mixing bowl holder is adapted to move the mixing bowl toward the auger when the collar is caused to move in an upward direction by the ball screw mechanism and to move away from the auger when the collar is moved in a downward direction by the ball screw mechanism.

Preferably, the mixing bowl is releasably held to the mixing bowl holder by co-operating holding means on the mixing bowl and mixing bowl holder.

Preferably, the holding means are a quick release camlock mechanism.

Preferably, the mixing bowl is a tapered cone with the taper pointing toward the base and interior of said cone is dimensioned to fully accommodate the auger therein.

Preferably, the auger has a tapered screw that tapers to a tip.

Preferably, the tapered tip of the auger is adapted to be situated above and adjacent the tapered interior bottom of the cone when the auger is positioned fully in to the interior of the said cone so as to achieve maximum and efficient mixing of the ingredients within the mixing cone.

Preferably, the splash guard is circular and has a diameter slightly less than the diameter of the open end of the mixing bowl.

Preferably, the splash guard is retained in position above the auger by an outer collar retainer positioned between the splash guard and the bottom surface of the upper housing.

Preferably, a vertical oriented activation holder is positioned within the interior of the column, the activation holder has a plurality of activation means along its length.

Preferably, the activation holder extends along and parallel to the longitudinal axis of the column and is spaced a distance from the screw ball such that as the screw block moves along the length of the ball screw it passes and activates the activation means in order to determine the relative position of the mixing bowl relative to the auger.

Preferably, each activation means is connected to the PLC that upon a respective activation of a respective activation means controls the operation of variable speed DC motor and drive motor.

Preferably, there are at least three activation means, namely:

(i) a first activation means situated on the switch/sensor holder adjacent the bottom of the screw ball, where the first activation means when activated by the screw block deactivates drive power to the variable speed DC motor;

(ii) a second activation means situated switch/sensor holder adjacent a mid region along the length of the ball screw wherein the auger is partially within the mixing bowl and the splash guard is in contact with the inner wall adjacent the open end of the mixing bowl, where the second activation means when activated by the screw block slows the speed of the variable DC motor and activates the drive motor to drive the auger; and (iii) a third activation means situated switch/sensor holder adjacent the top of the ball screw wherein the auger is fully within the mixing bowl, where the third activation means when activated by the screw block stops the variable DC motor whereby drive to the auger continues.

Preferably, a fourth activation means is situated between the second and third activation means, whereby the fourth activation means when activated by the screw block further slows the speed of the variable DC motor and thus the movement of the mixing bowl platform.

Preferably, the fourth activation means is positioned 30 mm below the third activation means.

Preferably, the activation means are switches.

Preferably, the switches are reed switches.

Preferably, the activation means are sensors.

Preferably, the sensors are LED sensors

Preferably, the mixing bowl has an extrusion outlet at its bottom to allow extrusion of the mixed mixture from the mixing bowl.

Preferably, the extrusion outlet has a valve such that when the mixing cone is used to make smoothies or milk shakes the valve can be closed.

Preferably, the mixing bowl has a handle.

Any other aspects herein described

BRIEF DESCRIPTION

The invention will now be described, by way of example only, by reference to the accompanying drawings:

FIG. 1 is a side section view of the blender with the mixing bowl in a lower stroke position in accordance with a preferred embodiment of the invention.

FIG. 2 is a side section view of the blender with the mixing bowl in a mid stroke position in accordance with a preferred embodiment of the invention.

FIG. 3 is a side section view of the blender with the mixing bowl in an upper stroke position in accordance with a preferred embodiment of the invention.

FIG. 4 is a front side isometric view of the blender as shown in accordance with a preferred embodiment of the invention.

FIG. 5 is a front side isometric ghost view of the blender as shown in FIG. 4 that show the inner working parts of the blender.

FIG. 6 is a rear side isometric ghost view of the blender as shown in FIG. 4 that show the inner working parts of the blender.

FIG. 7 is an isometric bottom view of the mixing bowl holder and mixing bowl shown in FIG. 1.

DESCRIPTION OF DRAWINGS

The following description will describe the invention in relation to preferred embodiments of the invention, namely a blender for mixing ingredients, typically ice cream, frozen yoghurt or other base product with condiments (fruits, nuts, etc), flavours or liquids (e.g. milk), to form a homogenous and well mixed product, typically a soft smooth dessert or drink such as a milk shake or smoothie. The invention is in no way limited to these preferred embodiments as they are purely to exemplify the invention only and that possible variations and modifications would be readily apparent without departing from the scope of the invention.

The blender as shown in FIGS. 1 to 7 will now be described.

Figure 1:
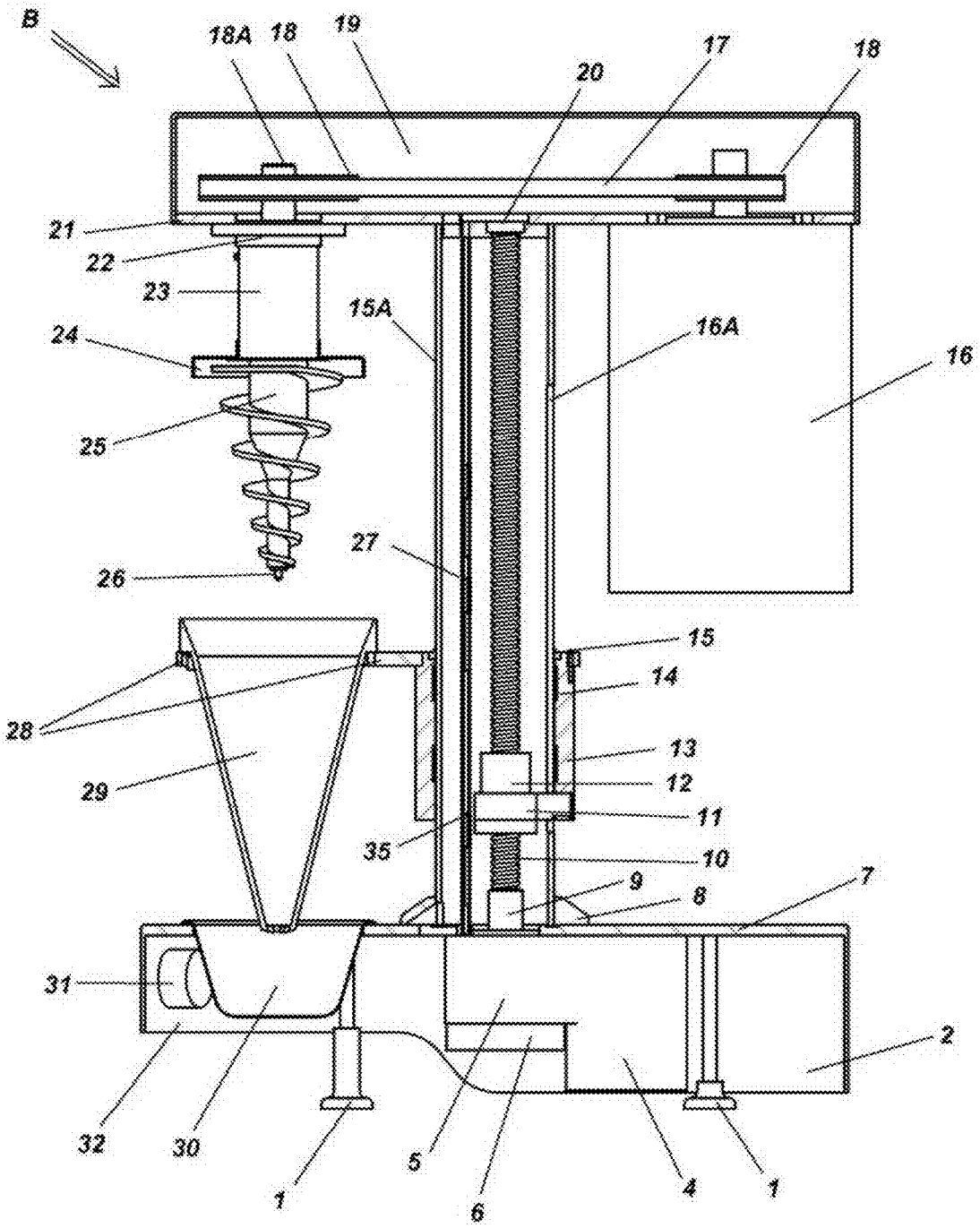

The blender B includes an upper frame 21 supported and spaced above a hollow base 2 by a hollow column 15A. The upper frame 21 includes drive motor 16, drive belt 17, drive pulleys 18, drive shaft 18A for driving auger 25 in coaxial alignment with the mixing bowl 29 and mixing bowl holder 28. The auger 25 is connected to the drive shaft 18A that has a portion thereof extending through an under surface of the upper frame 21 such that the auger 25 is positioned outside of the upper frame 21 and depends vertically downward from the upper frame 21 in a direction toward the base 2.

The column 15A defines an interior space which houses a ball screw mechanism for raising and lowering the mixing bowl 29 toward and away from the auger 25. The ball screw mechanism consists of a vertically orientated ball screw 10 situated within the interior of a column 15A. A screw block 11 has a screw nut 12 threadingly connected to the ball screw 10 so that the screw nut 12 is able to move up and down upon the ball screw 10 being rotated by a reversible variable speed DC motor 4 situated within the base 2. The screw block 11 has a portion that extends through a vertically aligned machined slot 16A in the column 15A.

The portion of the screw block 11 that extends outwardly through the slot 16A is connected to a collar 13 that is slidingly situated on the outer surface of the columns 15A. The slot 16A extends along a portion of the length of the column 15A so that the collar 13 is able to traverse that portion when the screw nut 12 is moved up and down upon the rotation of the ball screw 10.

The collar 13 has a mixing bowl holder 28 attached. The mixing bowl holder 28 extends outwardly from the collar 13 and is situated to be positioned in coaxial alignment with auger 25 such that the mixing bowl holder 28 is between the upper frame 21 and the base 2 such that the mixing bowl holder 28 is able to move the mixing bowl 29 toward the auger 25 when the collar is caused to move in an upward direction by the ball screw mechanism and to move away from the auger 25 when the collar is moved in a downward direction by the ball screw mechanism.

Figure 7:
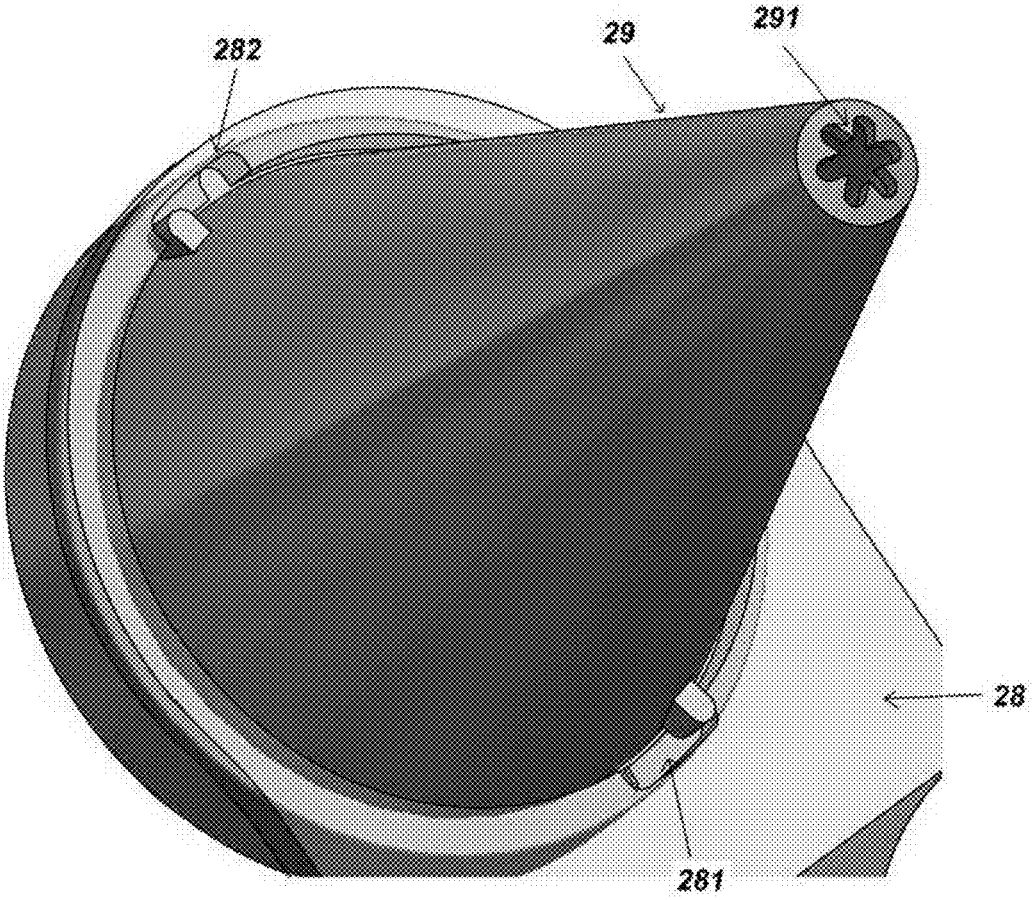

The mixing bowl 29 is held by the mixing bowl holder 28 by a quick release camlock mechanism (see FIG. 7). The camlock mechanism is shown having two cam locks 281. 282 in order to hold the mixing bowl 29 in place. It is envisaged that mixing bowl could be held in position by one or more camlocks. Also it is envisaged that other known holding/attaching mechanism could be used to hold the mixing bowl 29 to the mixing bowl holder 28.

Figure 3:
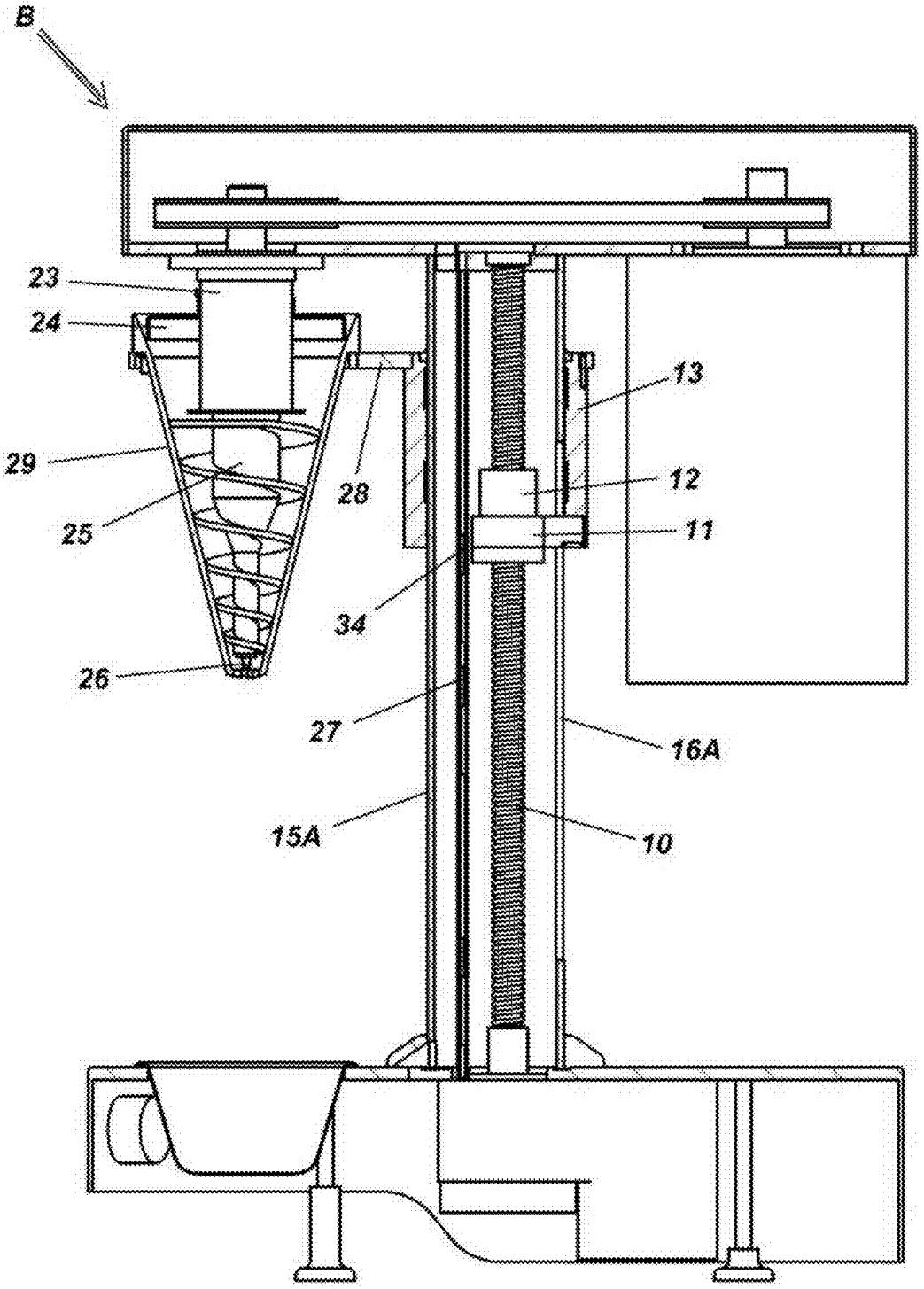
Figure 4:
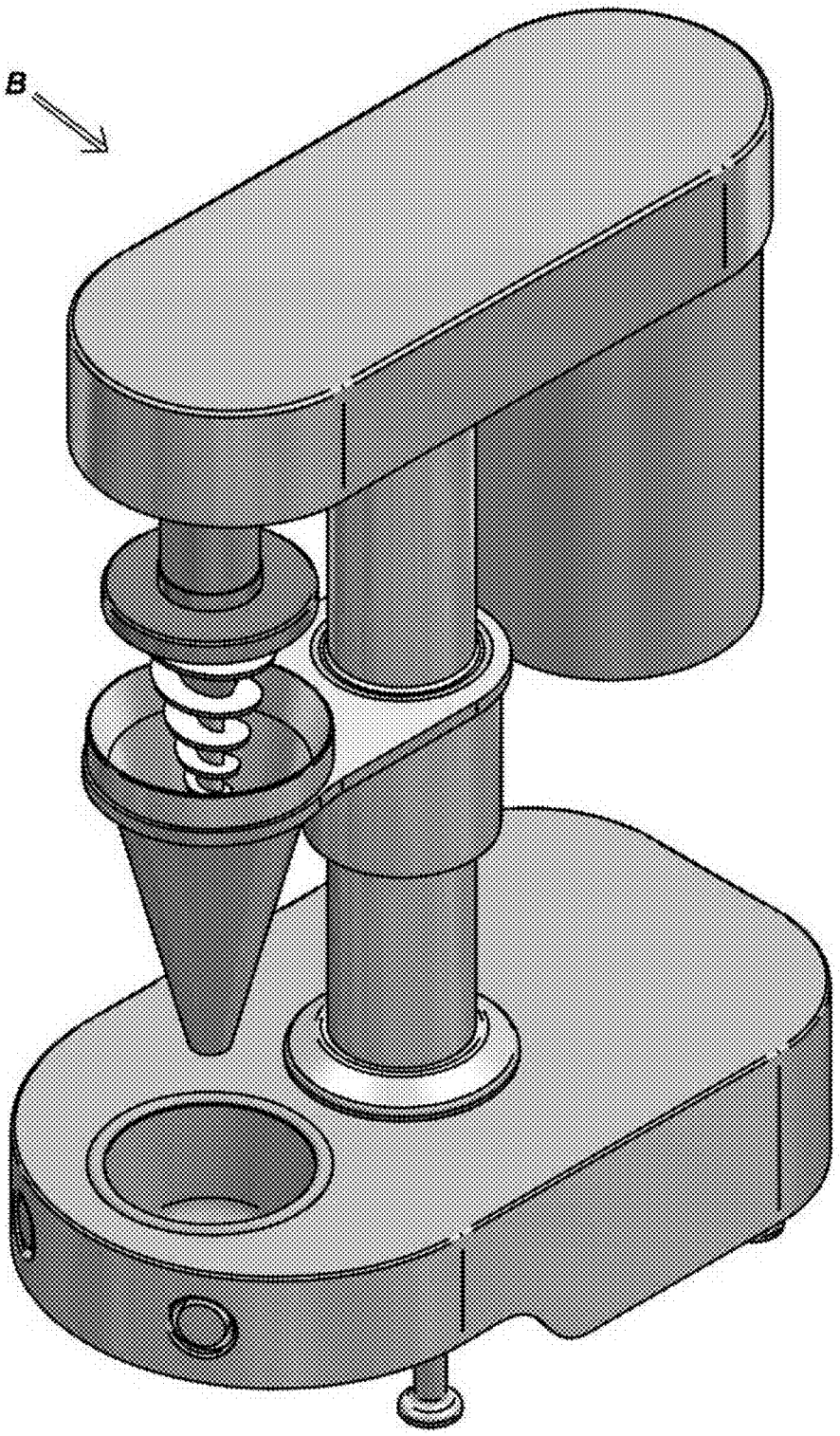
Figure 5:
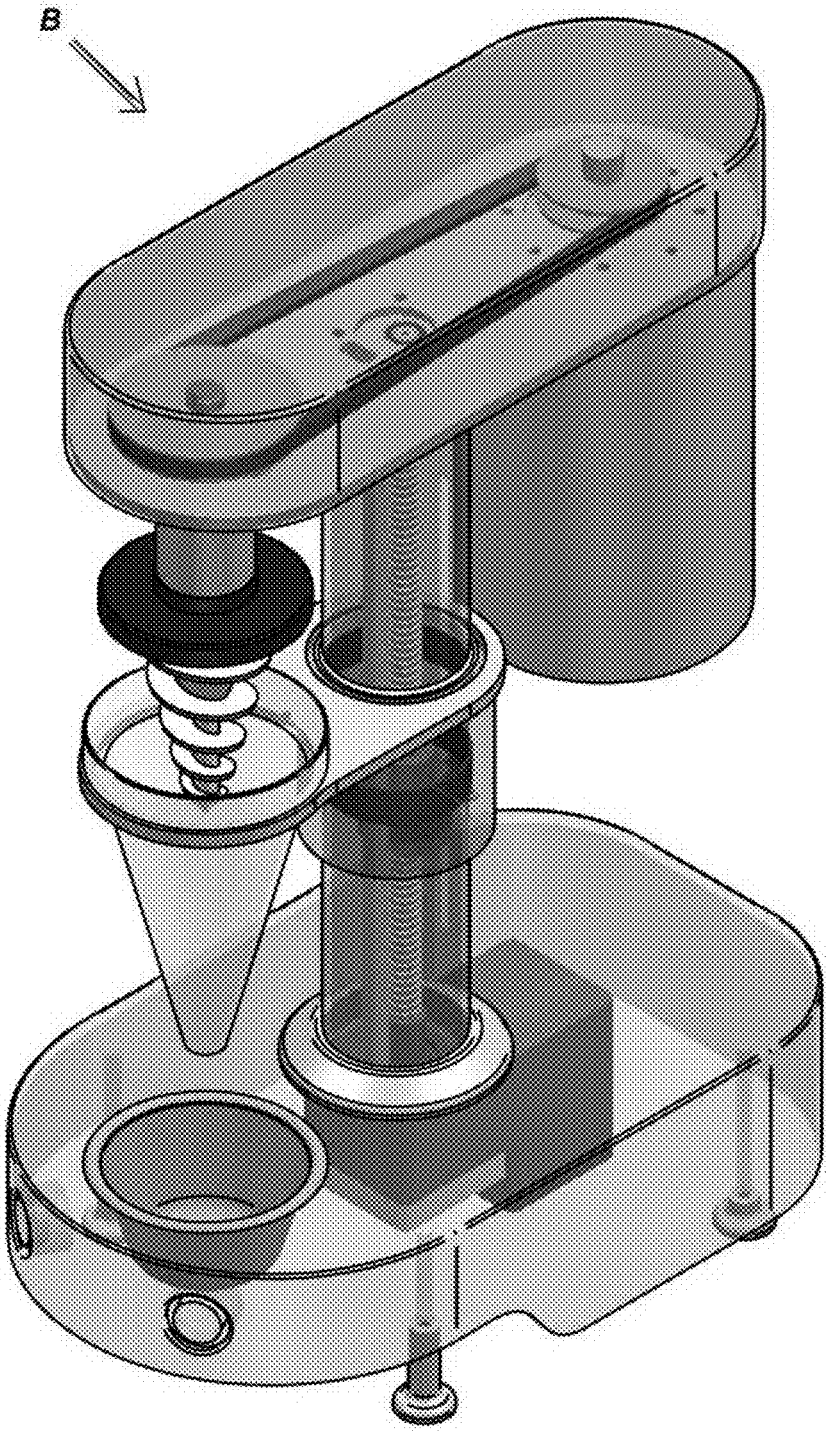
Figure 6:
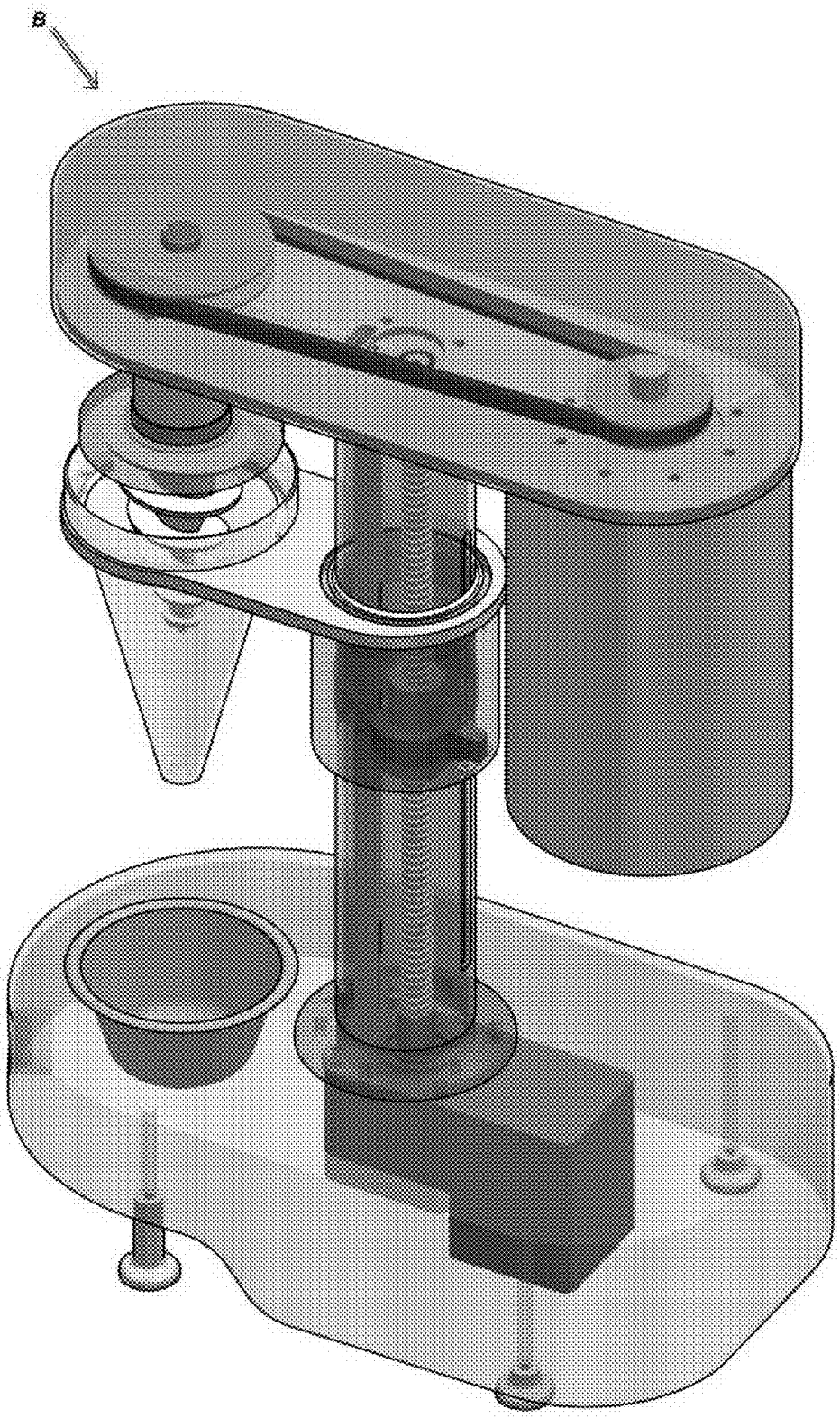

The mixing bowl 29 is a tapered cone and dimensioned to fully accommodate the tapered auger 25 therein as shown in FIG. 3 whereby the tip 26 of the auger is situated above and adjacent the tapered interior bottom of the mixing bowl 29 in order to achieve the maximum and efficient mixing of the ingredients within the mixing bowl. It is envisaged that other shapes of mixing bowl 29 could be used without departing from the scope of the invention.

The auger 25 has a tapered screw that tapers to a tip 26. A splash guard 24 is situated above the auger 25 a distance from the tip 26 whereby when the auger 25 is partially positioned within the mixing bowl 29 the splash guard 24 contacts the upper internal wall of the mixing bowl 29 so as to cover the open end of the mixing bowl 29 to prevent splashing and spillage of the ingredients during the mixing operation by the auger 25. As the mixing bowl is moved further upward the splash guard also moves upward, but retains in contact with the internal upper wall of the mixing bowl. The splash guard 24 is circular and has a diameter slightly less than the diameter of the open end of the mixing bowl 29. The splash guard 24 is retained in position above the auger 25 by an outer collar retainer 23 positioned between the auger 25 and the bottom surface of the top frame 21.

The base 2 is a hollow that has an interior space that houses the variable DC motor 4, gear box 5, thrust bearing 6, safety start switch 31, safety stop switch 32 and other suitable known electronic components such as PLC, etc that allow operation and control of the use of the blender B. The variable DC motor 4, gear box 5 and thrust bearing 6 drive and control the rotation of the ball screw 10. The base 2 has adjustable feet 1. The base 2 has an upper base plate 7 and a drip tray 30 situated directly below and in alignment with mixing bowl 29.

Figure 2:
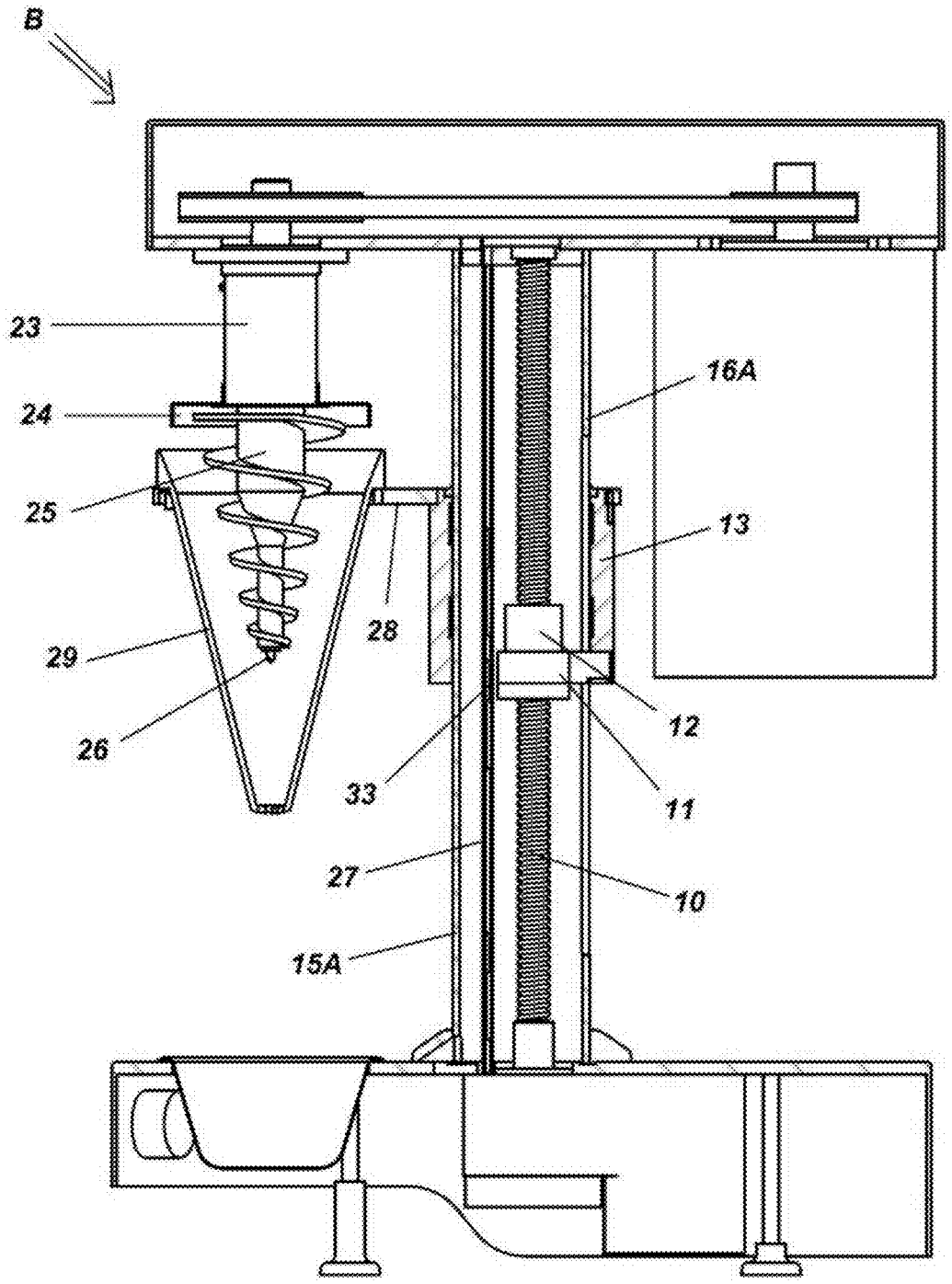

Within the column 15A there is a switch/sensor holder 27, preferably a reed switch/sensor holder 27, that has a plurality of switches or sensors along its length. The reed switch/sensor holder 27 extends along and parallel to the longitudinal axis of the column 15A and is in a spaced a distance from the screw ball 10 such that as the screw block 11 moves along the length of the ball screw 10 it passes a switch/sensor 33, 34, 35 in order to determine the relative position of the mixing bowl 29 relative to the auger 25. Each switch/sensor is connected to a controller (e.g. a PLC) that upon a respective activation of a respective switch/sensor controls the operation of variable DC motor 4 and drive motor 16. In FIG. 1, the screw block 11 is in its lower most position and adjacent bottom switch/sensor 35 and the blender B is in a non-use operation. In FIG. 2 the screw block 11 is adjacent a main switch/sensor 33 where the mixing bowl 29 has moved upward such that the auger 25 is partially with in the mixing bowl 29 and in this position the upward movement of the mixing bowl platform 28 is slowed by slowing the speed of the DC motor 4 and the auger 25 starts mixing by activation of the drive motor 16 once the splash guard 24 makes contact with the internal upper wall of the mixing bowl 29. In FIG. 3 the screw block 11 is adjacent the top switch/sensor 34 where the mixing bowl 29 has moved upward such that the auger 25 is fully within the mixing bowl 29 and in this position the upward movement of the mixing platform 28 is stopped by stopping the DC motor 4 and the auger 25 continues mixing. Preferably the switches/sensors are reed switches. It is envisaged that a fourth reed switch (not shown) can be placed between the mid and upper reed switch, preferably 30 mm below the upper switch, whereby the fourth reed switch further slows the movement of the mixing bowl platform 28.

The mixing bowl 29 as shown in the drawings is primarily a mixing bowl for the mixing of frozen products with non liquids as the bottom of the mixing cone has an extrusion outlet 291 to allow the mixture to be extruded from the mixing bowl once mixing is completed. For the making of milk shakes or smoothies using the blender a similar mixing bowl 29 is used, however this mixing bowl does not have an extrusion outlet 291 and may have a handle to allow for ease of tipping the milk shake or smoothie into a cup or drinking vessel. Another variation is for mixing bowl to have a valve to control the egress of mixture through the outlet 291 such that when not making milk shakes or smoothies the valve is open to allow mixture to be extruded via the outlet 291 from the mixing bowl and when making milk shakes or smoothies the valve is in a closed position to prevent liquid from exiting the mixing bowl via outlet 291.

A preferred operation of the Blender will now be described mixing a frozen product.

1. First put ice cream, frozen yoghurt or other base product into mixing bowl 29.
2. Then add any choice of fruit, nuts, confectionary, syrup etc.
3. Pushing in and holding start button 31 starts variable speed DC motor 4. Driving through gear box 5 into ball screw 10 driving up ball screw nut 12 attached to block 11, attached to collar 13, through machine slot 16A at the back of column 15A attached to collar 13 attached to mixing bowl 28 raises mixing bowl 29 approximately 220 mL at the top of which time the safety splash guard 24 is inserted into the top of the mixing bowl 29. At this position the main reed switch 33 is activated which slows down variable speed DC motor 4 and at the same time activates drive motor 16. Driving through pulleys 18 to the drive shaft 18A rotating auger 25.
4. During the next 80 mL the mixing bowl travels up, the ice cream fruit mix is blended into a smooth consistency similar to cream freeze with the fruit etc blended throughout the mix.
5. As the mixing bowl ascends the last 30 mm the product is extruded out of the restricted opening at the bottom of the mixing bowl 29.
6. At the top of its stroke the top limit reed switch 34 is activated which stops the variable speed DC motor 4, but by still holding your finger on the start button the mixing continues until all the product is extruded out of the mixing bowl leaving just a small amount of residue on the cone 29 and auger 25. At any time through the start and mixing cycle if the start button 31 is released both the variable speed DC motor 4 and main drive motor will stop and can be restarted at their present position by re-pushing the start button 31. At the end of the mixing cycle after all the product has been extruded the down button 32 is pushed and the variable speed DC motor 4 is reversed causing the mixing bowl 29 to descend to it's original position. As it passes the bottom limit reed switch 35 the variable speed DC motor shuts off.
7. After mixing is complete the mixing bowl platform 28 is lowered upon pressing the down switch 32. On the way down the DC motor goes at one speed.

A similar method of operation is used to make milk shakes or smoothies, however liquid is add at either step 1 or 2 and at step 6 there is no extrusion of the mixture from the mixing bowl.

NUMBERED MACHINE PARTS AS PER CRAVINGS

1. Adjustable foot pads
2. Base
4. Variable speed DC motor
5. Reduction box
6. Thrust bearing and holder
7. Base plate
8. Column mounting flange
9. Reduction box spicket
10. Ball screw
11. Ball screw lifting block
12. Ball screw nut
13. Collar
14. Wear seals
15. Seal
15A. Column
16. Main drive motor
16A. Machined slot in column
17. V belt
18. Drive pulleys
18A. Drive shaft
19. Top cover
20. Ball screw bearing
21. Top frame
22. Auger bearing spicket shaft assembly
23. Safety splash guard outer collar retainer
24. Safety splash guard
25. Auger
26. Auger tip
27. Reed switch holder
28. Mixing bowl holder
29. Mixing bowl
30. Drip tray
31. Safety recessed electrical start switch
32. Safety recessed electrical down switch
33. Main drive start reed switch
34. Variable speed DC motor top limit reed switch
35. Variable speed DC motor bottom limit reed switch Advantages a) Easy to use b) Greater and finer control of the movement of the mixing bowl toward the auger c) Variable speed control of the mixing bowl holder.

d) Robust and trouble free e) Improved safety features

Variations

Throughout the description of this specification, the word "comprise" and variations of that word such as "comprising" and "comprises", are not intended to exclude other additives, components, integers or steps.

It will of course be realised that while the foregoing has been given by way of illustrative example of this invention, all such and other modifications and variations thereto as would be apparent to persons skilled in the art are deemed to fall within the broad scope and ambit of this invention as is herein defined in the appended claims.

The invention claimed is:

1. A blender for continuous mixing ingredients, with condiments, flavours or liquids, to form a homogenous and well mixed product, the blender includes:

(i) a base having an interior space therein and the base includes start and stop switches for starting and stopping the operation of the blender;

(ii) a hollow central column extending upwardly from the base, the hollow central column having an interior space therein;

(iii) a top housing mounted to the top of the column, the top housing having a motor, drive transmission means and a drive shaft, the drive shaft extends downwardly and outwardly from said top housing;

(iv) an auger attached to a distal end of the drive shaft, the auger has a tapered screw that tapers to a tip;

(v) a mixing bowl having an open top, the mixing bowl is in substantially coaxial alignment with the auger, the bottom of the mixing bowl having a valved outlet so as to prevent liquids exiting the mixing bowl during blending;

(vi) a mixing bowl holder for releasably holding the mixing bowl in substantial coaxial alignment;

(vii) a ball screw drive mechanism housed within the interior of column and connectable to the mixing bowl holder for moving the mixing bowl in linear movement toward and away from the auger, the ball screw drive mechanism includes:

a) a vertically orientated ball screw situated within the interior space of the column extending upwardly from the base to the top housing;

b) a ball screw nut threadingly connected to the ball screw; and c) a screw block attached to the ball screw nut such that the screw block is adapted to move up and down upon rotation of the ball screw;

(viii) a floating and removeable safety splash guard positioned above the auger wherein the safety splash guard is adapted to fit within the opening of the mixing bowl such that the safety splash guard is able to contact with an upper internal wall below and adjacent the top of the mixing bowl so as to prevent splashing and spillage out of the opening of the mixing bowl when the blender is in use;

(ix) a vertically aligned slot in the column, where the slot extends along a portion of the length of the column, wherein the screw block has a portion that extends through the slot whereby the distal end of said portion is connected to a collar positioned on and surrounding the circumference of the column, the collar is attachable to the mixing bowl holder; and (x) a vertical oriented activation holder positioned within the interior of the column and extends along and parallel to the longitudinal axis of the column and is spaced a distance from the screw ball, the activation holder has a plurality of activation means along its length, such that as the screw block moves along the length of the ball screw it passes and activates activation means among the plurality of activation means in order to determine the relative position of the mixing bowl relative to the auger;

wherein the auger commences rotation automatically, when the mixing bowl comes into contact with the floating safety splash guard and continues to rotate as the mixing bowl is driven upward passing activation means among the plurality of activation means and stops only when the mixing bowl is in the uppermost position and the start switch released such that safe and variable control of the movement of the mixing bowl toward the auger is obtainable.

2. The blender as claimed in claim 1, wherein the ball screw is drivingly connected to a reversible motor housed in the interior of the base such that ball screw can be rotated in one direction to move the screw block up the length of the ball screw and can be rotated in the opposite direction to move the screw block down the length of the ball screw.

3. The blender as claimed in claim 2, wherein the reversible motor is a variable speed DC motor so that the speed of rotation of the screw ball can be varied and controlled.

4. The blender as claimed in claim 3, wherein, the reversible motor is coupled to a gear reduction box situated between the reversible motor and the ball screw.

5. The blender as claimed in claim 4, wherein, the base includes a PLC therein to control the operation of the reversible motor and the drive motor.

6. The blender as claimed in claim 1, wherein the base includes therein all the electronic components required for the operation and control of the blender.

7. The blender as claimed in claim 1, wherein the base has adjustable feet depending downwardly therefrom.

8. The blender as claimed in claim 1, wherein the base includes a horizontal upper base plate.

9. The blender as claimed in claim 1, wherein the base includes a drip tray situated directly below and in alignment with mixing bowl.

10. The blender as claimed in claim 1, wherein the collar is adapted to slide up and down the column as the screw block is caused to move up and down the ball screw.

11. The blender as claimed in claim 10, wherein the mixing bowl holder extends outwardly from the collar and situated to be positioned in coaxial alignment with auger such that the mixing bowl holder is adapted to move the mixing bowl toward the auger when the collar is caused to move in an upward direction by the ball screw mechanism and to move away from the auger when the collar is moved in a downward direction by the ball screw mechanism.

12. The blender as claimed in claim 1, wherein, the mixing bowl is releasably held to the mixing bowl holder by co-operating holding means on the mixing bowl and mixing bowl holder.

13. The blender as claimed in claim 12, wherein the holding means are a quick release camlock mechanism.

14. The blender as claimed in claim 1, wherein the mixing bowl is a tapered cone with the taper pointing toward the base and interior of said cone is dimensioned to fully accommodate the auger therein.

15. The blender as claimed in claim 14, wherein the tapered tip of the auger is adapted to be situated above and adjacent the tapered interior bottom of the cone when the auger is positioned fully in to the interior of the said cone so as to achieve maximum and efficient mixing of the ingredients within the mixing cone.

16. The blender as claimed in claim 1, wherein the safety splash guard is circular and has a diameter slightly less than the diameter of the open end of the mixing bowl.

17. The blender as claimed in claim 1, wherein the safety splash guard is retained in position above the auger by an outer collar retainer positioned between the auger and the bottom surface of the upper housing.

18. The blender as claimed in claim 5, wherein each activation means is connected to the PLC that upon a respective activation of a respective activation means controls the operation of variable speed DC motor and drive motor.

19. The blender as claimed in claim 18, wherein there are at least three activation means, namely:

(i) a first activation means situated on the switch/sensor holder adjacent the bottom of the screw ball, where the first activation means when activated by the screw block deactivates drive power to the variable speed DC motor;

(ii) a second activation means situated switch/sensor holder adjacent a mid region along the length of the ball screw wherein the auger is partially within the mixing bowl and the safety splash guard is in contact with the internal wall adjacent the opening of the mixing bowl, where the second activation means when activated by the screw block slows the speed of the variable DC motor and activates the drive motor to drive the auger; and (iii) a third activation means situated switch/sensor holder adjacent the top of the ball screw wherein the auger is fully within the mixing bowl, where the third activation means when activated by the screw block stops the variable DC motor whereby drive to the auger continues.

20. The blender as claimed in claim 19, wherein a fourth activation means is situated between the second and third activation means, whereby the fourth activation means when activated by the screw block further slows the speed of the variable DC motor and thus the movement of the mixing bowl platform.

21. The blender as claimed in claim 20, wherein the fourth activation means is positioned 30 mm below the third activation means.

22. The blender as claimed in claim 21, wherein, the activation means are switches.

23. The blender as claimed in claim 22, wherein the switches are reed switches.

24. The blender as claimed in claim 20, wherein the activation means are sensors.

25. The blender as claimed in claim 24, wherein the sensors are LED sensors.

26. The blender as claimed in claim 1, wherein the valved outlet is an extrusion outlet that allows the mixed mixture to be extruded from the mixing bowl.

27. The blender as claimed in claim 26, wherein the extrusion outlet has a valve such that when the mixing cone is used to make smoothies or milk shakes the valve can be closed.

* * * * *